United States Patent [19]

Rouzee

[11] Patent Number: 4,631,935

[45] Date of Patent: Dec. 30, 1986

[54] SECURITY DEVICE AGAINST ATTACK ON A LOCK

[75] Inventor: Daniel B. Rouzee, Vanves, France

[73] Assignee: Fichet-Bauche, France

[21] Appl. No.: 701,981

[22] Filed: Feb. 15, 1985

[30] Foreign Application Priority Data

Feb. 20, 1984 [FR] France ..... 8402523

[51] Int. Cl.[4] ..... E05B 63/00

[52] U.S. Cl. ..... 70/1.5; 70/416

[58] Field of Search ..... 70/1.5, 1.7, 333, 416; 109/30

[56] References Cited

U.S. PATENT DOCUMENTS 4,143,528 3/1979 Weber ..... 70/1.5

4,512,165 4/1985 Ujeda ..... 70/1.5

FOREIGN PATENT DOCUMENTS 0034019 8/1981 European Pat. Off. .

WO83/00465 2/1983 World Int. Prop. O. ..... 70/1.5

2136046 9/1984 United Kingdom ..... 70/416

*Primary Examiner*—Robert L. Wolfe

*Attorney, Agent, or Firm*—Steinberg & Raskin

[57] ABSTRACT

The present invention relates to a security device against attacks on a lock comprising a member mounted pivotally on a lock body and one end of which retains a finger constantly acted upon by a spring, whereas the other end of the member is provided with a slot identical in shape with at least a portion of the lock inlet receiving the key.

8 Claims, 2 Drawing Figures

SECURITY DEVICE AGAINST ATTACK ON A LOCK

BACKGROUND OF THE INVENTION

The present invention has essentially for a subject matter a security device against attack on a lock.

It is also directed to a door of, for example, a strong-box, strong-chest, strong-cabinet or a safe, the lock of which is equipped with such a device.

There has already been proposed to equip locks with means referred to as "detectors" which are adapted to be tripped under the action of an attack, so as to prevent the operation of the lock mechanism.

For example, locks are already known which are provided with a finger acted upon by a spring retained by means of, for example, a wire, which wire may be slackened or severed under the action of an attack on the lock to thus free the finger and cause it to lock an element of the lock mechanism.

However, the means hitherto proposed for retaining and freeing the detector finger used to form with the latter an assembly which was relatively difficult to mount, rather expensive and could not be adapted to all types of locks.

SUMMARY OF THE INVENTION

The present invention has for a purpose to remedy these drawbacks by providing a security device against attack on a lock inlet or nose, which is particularly simple and compact, inexpensive, capable of adaptation to various types of locks, and all elements of which are advantageously concentrated on the lock body.

To this end, the invention has for a subject matter a security device against attack on a lock, of the type including a retained movable element, such as for example a finger, acted upon by a return means and adapted to be freed under the action of an attack so as to prevent the the operation of the lock mechanism, characterized by a member mounted pivotally on the lock body and one end, or first end, of which retains the said movable element or finger, whereas the other end, or second end, of the said member is geometrically identical with at least a portion of the lock inlet receiving the key.

It is thus understood that when an attack on the lock is attempted, particularly to means of a drilling tool applied to the lock inlet or nose, the said pivotally mounted member is driven in rotation and operates as a lever to free the detector finger which thus locks the lock mechanism. Of course, the key for opening or closing the lock has no influence, during its introduction or its withdrawal, on the pivoting member actuating the detector finger.

According to another feature of the invention, the second end of the pivoting member may be lodged in a slit provided in the lock nose projecting from the lock body, the said slot being orthogonal with the axis of the lock inlet into the said nose.

Furthermore, the second end of the pivoting member is provided with at least one slot or the like corresponding exactly with at least a portion of the lock inlet and of the key bit.

According to still another feature of the invention, the said member is pivotally mounted on the lock body through the medium of a pivot pin cast integral with the said body or attached thereto.

As for the aforesaid first end of the pivoting member, it enters a slot provided in the said movable element or finger perpendicularly to the axis of the said finger.

According to another feature of the invention, the said movable element or finger is slidingly mounted in a bore tangential to the lock body and containing a spring.

Also, the said movable element or finger, when freed, enters a lock element so as to lock the same.

The above device is advantageously applicable to a lock of any type intended to be fitted to any door, such as for example a door of a safe or of a strong-box or the like.

BRIEF DESCRIPTION OF THE DRAWINGS

But other features and advantages of the invention will appear more clearly from the following detailed description with reference to the appended drawings given solely by way of example and wherein.

DESCRIPTION OF THE PREFERRED EMBODIMENT

Figure 2:
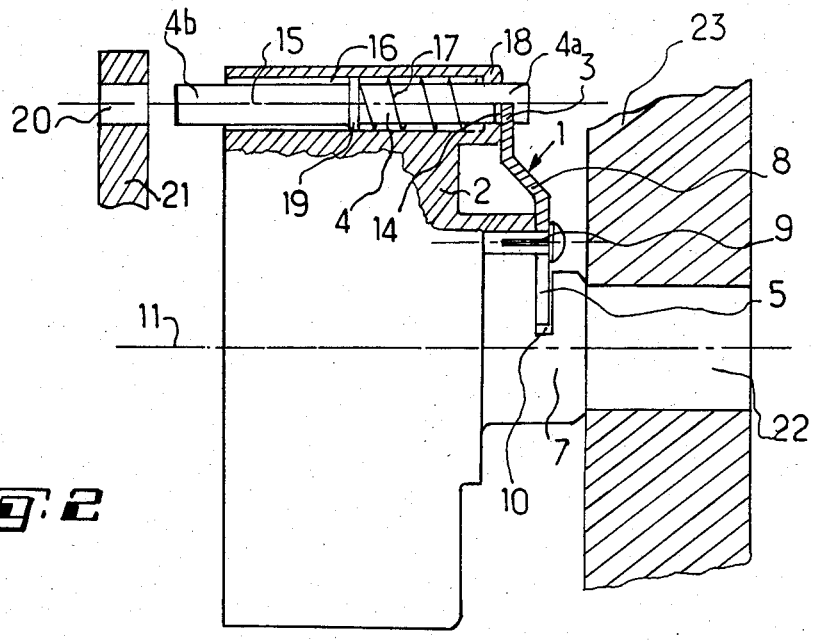
FIG. 2 is a side elevational view of the lock of FIG. 1, with parts thereof shown in section.

According to an example of embodiment and referring to the appended drawings, the security device against attack on a lock according to the invention includes essentially a member 1 pivotally mounted on the lock body 2 and including a first end 3 adapted to retain a movable finger 4, and a second end 5 which is geometrically identical with the lock inlet 6 receiving the key, the said inlet being provided in a nose portion 7 of the lock, projecting from the lock body 2 as seen clearly in FIG. 2.

The member 1 is in the form of a rigid, somewhat deformed strap, as shown at 8 in FIG. 2, the said strap being mounted pivotally on the lock body 2 through the medium of a small pin such as for example a headed and grooved pin 9 press-fitted into the said body. Instead of this small pin, there may perfectly be provided, without departing from the scope of the invention, a small cylindrical or like projection on the body 2, cast or molded integral with the latter.

Thus, as is readily understood, the member or strap 1 is capable of pivoting in the same manner as a lever in one direction or the other about the pin 9.

Figure 1:
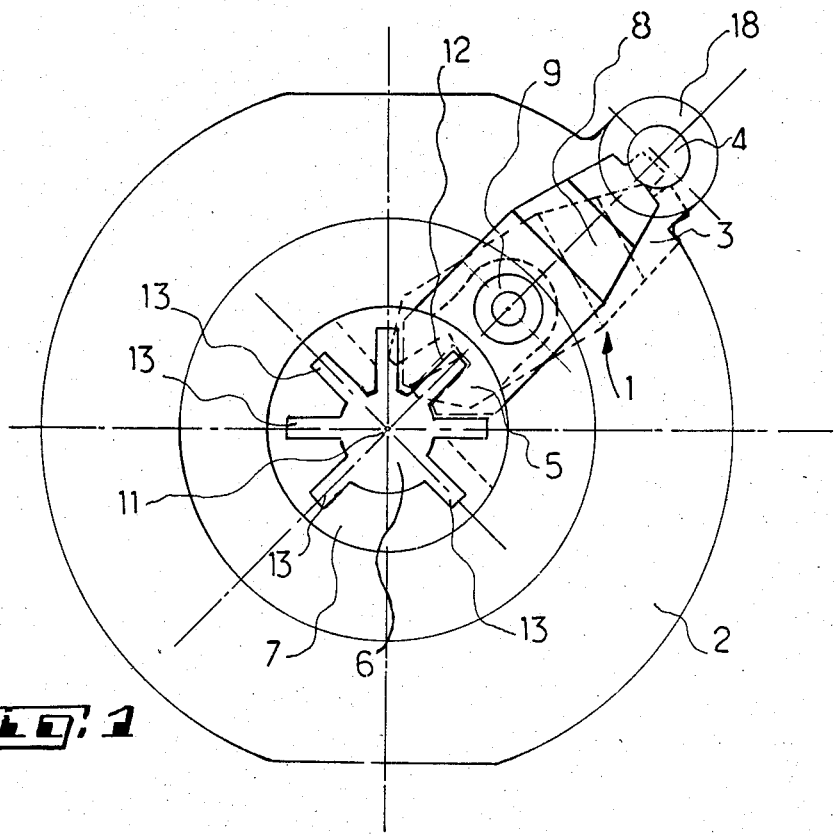
FIG. 1 is a front view of the inlet of a lock equipped with a device according to the invention.

As seen clearly in FIG. 2, the second end 5 of the strap 1 may be lodged in a slit 10 provided in the lock nose 7, the said slit being orthogonal with the axis 11 of the lock inlet 6. Referring now to FIG. 1, it is seen that the second end 5 of the strap 1 is provided with a through-slot 12 corresponding exactly to a portion of the lock inlet which, in the example illustrated, is star-shaped. More precisely, the slot 12 has exactly the same dimensions as one of the branches 13 of the star-shaped hole forming the lock inlet 6 into the nose 7.

The first end 3 of the pivoting strap 1 enters a slot 14 provided at the end of the movable finger 4 in perpendicular relationship to the axis 15 of the said finger.

As appears clearly from the Figures, the movable finger 4 is slidingly mounted in a bore 16 tangential to the lock body 2 and containing a spring 17 constantly urging the finger 4 to its protruding position, i.e. towards the left in FIG. 2.

The end **4*a* of finger 4, retained by the strap 1, projects outwardly of a portion 18 of the lock body 2, the said portion forming, as it were, a housing for the finger 4. The spring 17 bears against the inner end wall of the housing 18 and a collar or the like 19 integral with or secured to the movable finger 4**.

The free end 4*b* of the finger 4, when the latter is released, enters an orifice 20 of a lock element 21 to thus lock the same. It will be noted that the lock element 21 has been shown diagrammatically, it being understood that it may be any element capable of actuating the bolts of the lock.

The operation of the device of the invention is inferred from the foregoing description and will be explained briefly hereafter.

In the normal operating position, the strap 1 is in the position shown in FIG. 2 or in the position shown in full lines in FIG. 1. Otherwise stated, the end 3 of the strap 1 retains the detector finger 4 by being lodged in the slot 14, and the slot 12 at the other end 5 of the strap 1 coincides with one of the branches 13 of the lock inlet 6. In other words, when the user introduces his key into the orifice 22 the door 23 of, for example, a safe, and then into the inlet 6 provided in the lock nose 7, nothing takes place. Indeed, during both the introduction and the withdrawal of the key, the key web slides in the branches 13 of the lock inlet 6, it being understood that the slot 12 of the strap 1 will not interfere with the passage of the key.

If an attempt is made to force the key nose 7 by using for example a drilling tool, this, as is readily understood, necessarily results in the rotation of the strap 1 in one direction or the other about the pin 9, so that the end 3 of this strap will escape from the slot 14 of the movable finger 4 and the latter will immediately enter the orifice 20 of the element 21 to thus lock the lock mechanism.

There is therefore obtained, according to the invention, a lock security device which is very compact, extremely simple and reliable and can be mounted on the body of any lock, such a device being particularly sensitive to attempted attacks on the lock nose by means of, for example, drilling tools.

Of course, the invention is by no means limited to the form of embodiment described and illustrated which has been given by way of example only.

For example, the device of the invention can be easily adapted to any lock inlet, on condition simply that a slot 12 be provided at the end of the strap actuating the detector finger, the shape of which is geometrically identical with at least a portion of the inlet orifice of the lock nose.

The invention therefore includes all technical equivalents to the means described as well as their combinations should the latter be carried out according to its gist.

What is claimed is:

1. A security device against attacks on a lock which comprises a lock mechanism, a lock body, and a lock inlet adapted to receive a key, said device comprising a retained finger movable with respect to said lock body, return means adapted to act upon said finger to free the same under the action of an attack and to thus prevent the operation of the lock mechanism, and a member pivotally mounted on the lock body and having a first and second end portions, said first end portion retaining said movable finger, whereas the second end portion of said member is substantially geometrically identical with at least a portion of the lock inlet receiving the key.

2. A security device according to claim 1, wherein said lock inlet includes a lock nose projecting from the lock body and provided with a slit substantially orthogonal with an axis of the lock inlet, and said second end portion of the pivoting member can be lodged in said slit.

3. A security device according to claim 1, wherein the second end portion of the pivoting member is provided with at least one slot substantially corresponding exactly to at least a portion of the lock inlet.

4. A security device according to claim 1, wherein said member is pivotally mounted on the lock body through the medium of a pivot pin cast integral with said body or fastened thereto.

5. A security device according to claim 1, wherein said movable finger comprises a slot substantially perpendicular to an axis of said finger, and said first end portion of the pivoting member is adapted to enter said slot.

6. A device according to claim 1, wherein said lock body comprises a bore tangential thereto and containing a spring constituting said return means, and said movable finger is slidingly mounted in said bore.

7. A device according to claim 1, wherein said lock comprises an element into which said movable finger penetrates when freed under the action of an attack against said lock inlet.

8. A device according to claim 1, wherein said lock inlet comprises a star-shaped hole.

* * * * *